US006279705B1

(12) United States Patent
Wu

(10) Patent No.: US 6,279,705 B1
(45) Date of Patent: Aug. 28, 2001

(54) WHEELED LUGGAGE WITH THIRD WHEEL CONTROL MECHANISM

(75) Inventor: Andy Chun Hsin Wu, San Chung (TW)

(73) Assignee: Chaw Khong Technology Co., Ltd., San Chung (TW)

( * ) Notice: Subject to any disclaimer, the term of this patent is extended or adjusted under 35 U.S.C. 154(b) by 0 days.

(21) Appl. No.: 09/433,740

(22) Filed: Nov. 4, 1999

Related U.S. Application Data

(63) Continuation-in-part of application No. 09/390,670, filed on Sep. 7, 1999, now abandoned.

(51) Int. Cl.[7] ..... A45C 5/14
(52) U.S. Cl. ..... 190/18 A; 190/115; 280/37
(58) Field of Search ..... 280/37, 47.2; 16/115; 190/18 A, 39, 115

(56) References Cited

U.S. PATENT DOCUMENTS 4,122,924 * 10/1978 Wasserman ..... 190/18 A
4,852,705 * 8/1989 Cowan, Jr. ..... 190/18 A
5,519,919 * 5/1996 Lee ..... 280/47.2 X
5,568,848 * 10/1996 Liang ..... 190/18 A
5,613,273 * 3/1997 Tsai ..... 190/18 A X
5,873,439 * 2/1999 Liang ..... 190/18 A
5,984,326 * 11/1999 Abraham et al. ..... 190/18 Z X

FOREIGN PATENT DOCUMENTS

8001671 * 8/1980 (WO) ..... 190/18 A

* cited by examiner

*Primary Examiner*—Sue A. Weaver
(74) *Attorney, Agent, or Firm*—Dougherty & Troxell

(57) ABSTRACT

A wheeled luggage with a third wheel control mechanism in which release button is disposed within the bezel for controlling the extension of third wheel by actuating a connecting rod attached between release button and third wheel control lever in particularly, the extension of the third wheel is actuated simply by pressing the release button provided within the bezel and the retraction of the same is only to push to third wheel bracket plate into the back plate of luggage and to have it locked thereto. The location of the connecting rod is preferable near the retractable handle. By utilizing this, connecting rod is enhanced in mechanical strength for preventing from being deformed by the weight of luggage during transportation, and an easy assembling and a simplified controlling mechanism are obtained.

17 Claims, 14 Drawing Sheets

WHEELED LUGGAGE WITH THIRD WHEEL CONTROL MECHANISM

This is a continuation-in-part application of U.S. Ser. No. 09/390,670 which was filed on Sep. 7, 1999 now abandoned. This application is a continuation-in-part application of prior U.S. patent application filed on Sep. 7, 1999 entitled "Wheeled Luggage with Third Wheel Control Mechanism" now is pending.

BACKGROUND OF THE INVENTION

1. Field of the Invention

This invention relates to a wheeled luggage with a third wheel control mechanism for the purpose of controlling the extension of the third wheel unit.

2. Description of Related Art

A wheeled luggage is widely used by travelers at airports to carry personal belongings, which is equipped with wheels and an extendable handle that allows the user to easily and effortlessly carry the luggage by dragging it on its wheels along the ground. The extendable handle is normally retracted and locked in the luggage and can be unlocked to be extended out for the user to drag the wheeled luggage along the ground.

Conventional wheeled luggages are typically provided with only two wheels on the bottom. This type of wheeled luggage, however, is inconvenient to use since the wheeled luggage would not stand by itself on two wheels. Moreover, the inclination of the luggage would cause part of the weight of the luggage to be transferred to the user's dragging hand, thus requiring the user to use more effort to drag the wheeled luggage. As a solution to this problem, newer types of wheeled luggages are provided with a third wheel unit in addition to the main wheel unit. The third wheel unit is normally collapsed to the luggage, and can be expanded to serve an additional wheel unit that allows the wheeled luggage to stand by itself on three wheels.

One such wheeled luggage is shown in FIG. 1. As shown, the luggage A includes an extendable handle B, a main wheel unit C, and a third wheel unit D. The third wheel unit D includes a hinge D1, an expandable frame D2, a wheel D3, and a foldable arm D4. When not in use, the third wheel unit D is collapsed into the luggage to facilitate convenient storage. To allow the luggage to stand by itself on three wheels, the third wheel unit D can be expanded to allow the luggage to stand by itself on three wheels. Moreover, the third wheel unit can take on part of the weight of the luggage resulted from the inclination of the luggage, thus allowing the user to drag the luggage with less effort along the way.

One drawback to this wheeled luggage, however, is that the expansion of the third wheel unit need to be done by hand. When doing this, the user's hand may be hurt by the expandable frame if care is not taken. There exists, therefore, a need for a new mechanism that allows the third wheel unit to be automatically expanded from the luggage when it is used.

SUMMARY OF THE INVENTION

It is therefore an objective of the present invention to provide a luggage with a third wheel control mechanism, which allows the third wheel unit to be extended for use to support the luggage when the handle is being extended for use, and also allows the third wheel unit to be collapsed into the luggage when it is not used, thereby obviating prior art third wheel deficiencies.

It is another objective of the present invention to provide a luggage with a third wheel control mechanism having a third wheel unit, which allows the third wheel unit to be effortlessly extended by the user.

In accordance with the forgoing and other objectives of the present invention, a third wheel control mechanism for the third wheel unit at the lower portion of the luggage and near the outer tube of retractable handle is provided.

A further object of the present invention is to provide a wheeled luggage with a third wheel control mechanism in which release button is disposed within the bezel for controlling the expansion of third wheel by actuating a connecting rod attached between release button and third wheel control lever. In particularly, the location of the connecting rod is preferable near the inner and outer tubes of the retractable handle. By utilizing this, connecting rod is enhanced in mechanical strength for preventing from being deformed by the weight of luggage during transportation, and an easy assembling and a simplified controlling mechanism are obtained.

A still further object of the present invention is to provide a wheeled luggage with an improved third wheel control mechanism in which the third wheel is of caster provided on a wheel mount capable of being freely rotated at random thus facilitating to wheel along a supporting surface.

A still further object of the present invention is to provide a wheeled luggage with an improved third wheel control mechanism in which the supporting member of the third wheel bracket plate is generally extended into a great invert V shape in contact with supporting surface thus facilitating the bracket plate to be easily collapsed into the main body when not used.

A still further object of the present invention is to provide a wheeled luggage with an improved third wheel control mechanism in which a collar member is further provided to enclose a section of guiding channel of inner supporting plate for further securing each of retractable handle tubes to be smoothly passed therethrough.

BRIEF DESCRIPTION OF THE DRAWING

The invention can be more fully understood by reading the following detailed description of the preferred embodiments, with reference made to the accompanying drawings, wherein.

DETAILED DESCRIPTION OF THE PREFERRED EMBODIMENTS

Figure 1:
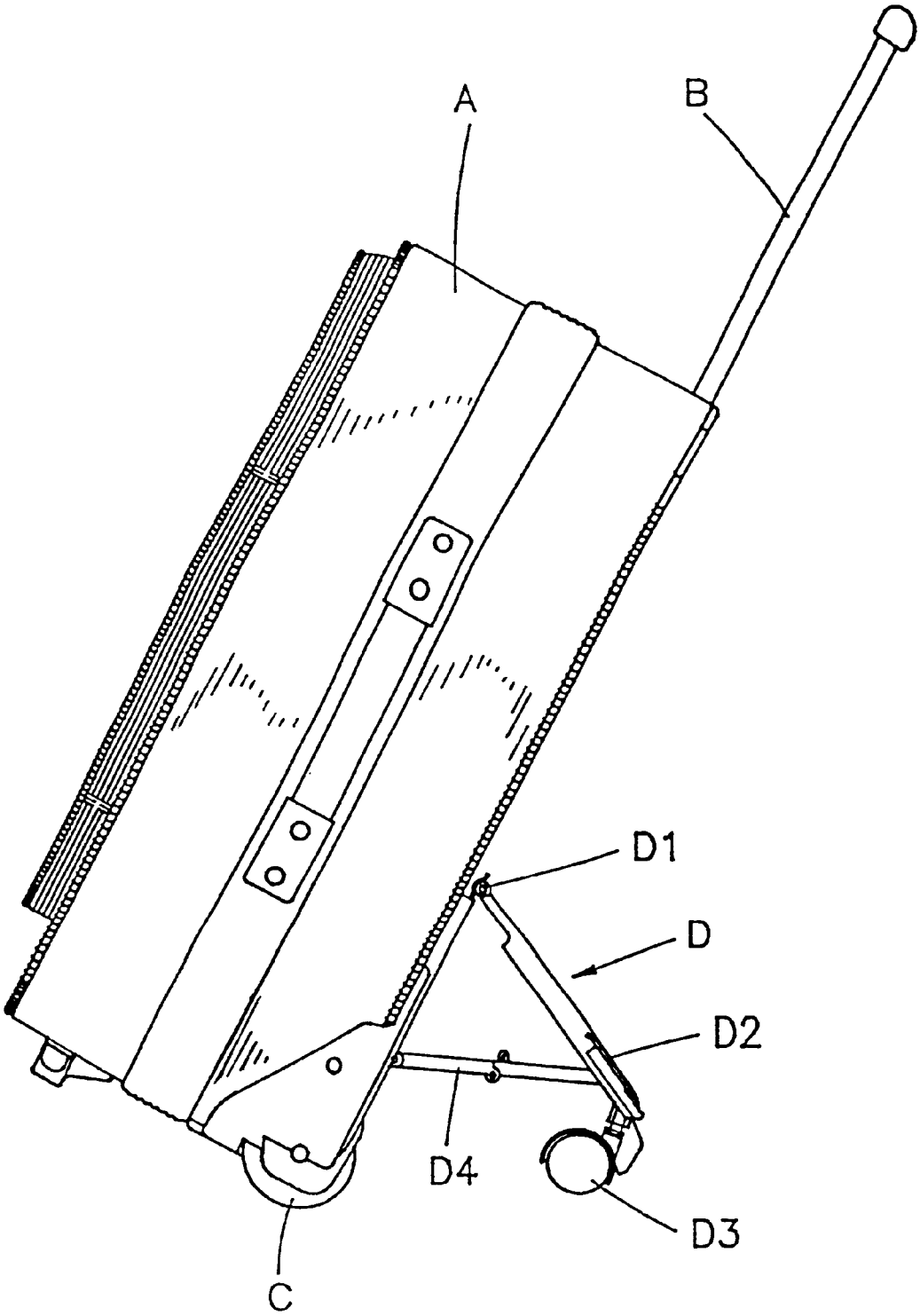
FIG. 1 (PRIOR ART)
FIG. 1 is a side view of a prior art wheeled luggage having a third wheel.

Referring to FIGS. 2–7B, a wheeled luggage comprises a luggage 10, a bezel 12 provided on top of luggage 10, and a pair of retractable handles 11 have a pair of supporting tubes 11A provided within luggage 10. A third wheel control mechanism 30 is provided below bezel 12 comprising a release button 31 within bezel 12, a vertically disposed connecting rod 32 actuated by release button 31 a pivotal lever 34 actuated by connecting rod 32, an anchored spring 33 held by a socket 330 for keeping pivotal lever 34 in a horizontal position normally, a third wheel bracket plate 35 having a third wheel 352 at the lower portion, pivotally attached to a back plate of luggage at the top portion, a resilient hinge 351 attached a third wheel bracket plate 35 to a back plate of luggage 10, the back plate of luggage 10 having an inner supporting plate 40 and an outer supporting plate 41 for supporting third wheel bracket plate 35, and a hooking member 37 (see FIGS. 4A, 5A, 5B and 7A) for locking third wheel bracket plate 35 onto back plate of luggage 10 by engaging with pivotal lever 34 when retracted. It is to be understood that the third wheel control mechanism 30 is provided near retractable handle 11 (see FIG. 3) for facilitating the maneuverability of third wheel bracket plate 35. In detail, the release button 31 is very close to one supporting tubes 11A. A novel feature of the invention is that a number of supporting collar members 321 equally spaced along the recess 411 of the outer supporting plate 41 for providing an adequate support to and guiding connecting rod 32. Such simplified support and guiding components for connection rod 32 thus will cause connecting rod 32 to be not susceptible to damage by the weight of luggage 10 during transport. On the other hand, if desired, the release button 31 may be positioned in the center portion of the bezel, as shown in FIG. 3A.

Figure 2:
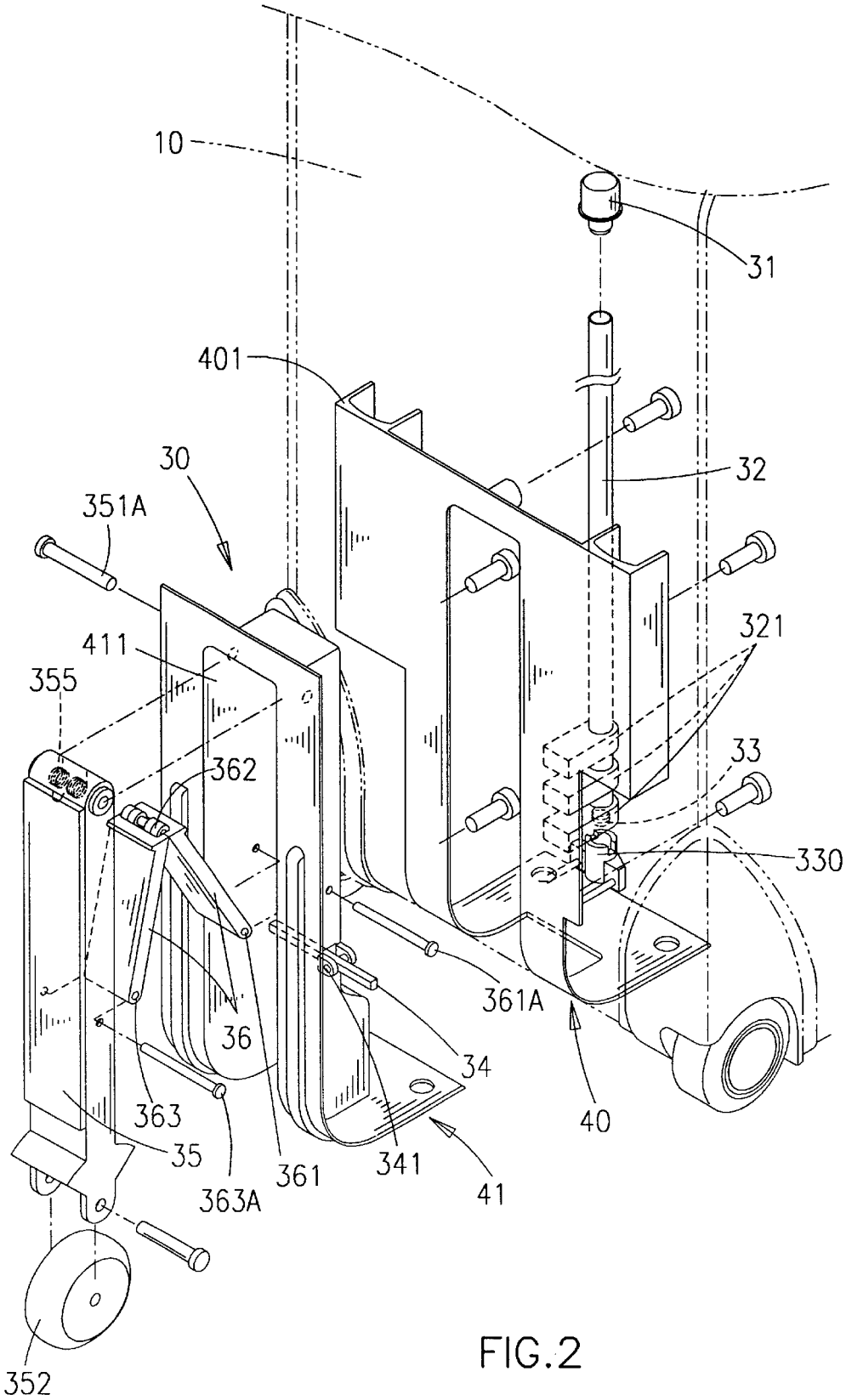
FIG. 2 is an exploded view of third wheel control mechanism installed in a luggage according to a preferred embodiment of the present invention.
Figure 3:
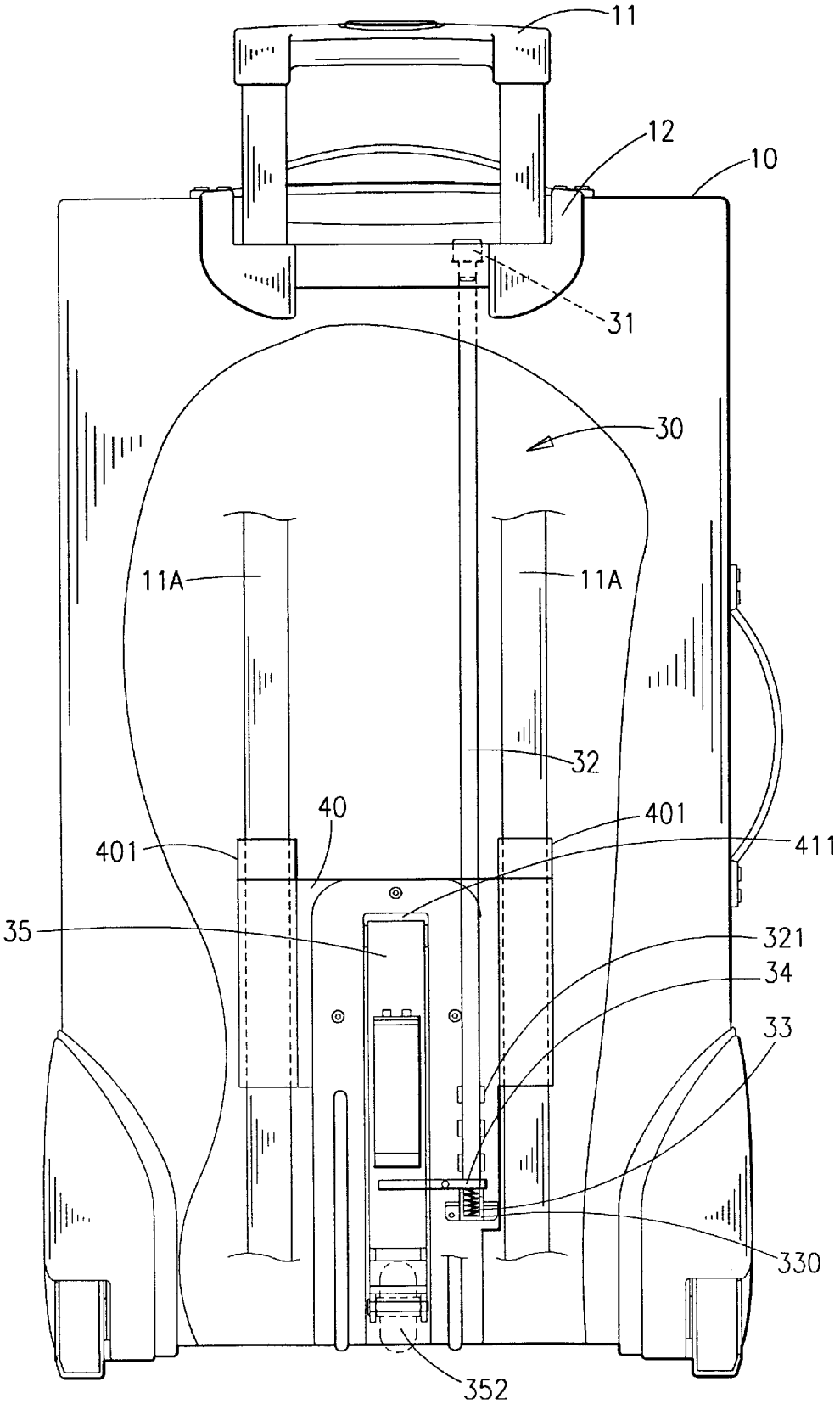
FIG. 3 is a rear view of a wheeled luggage with third wheel control mechanism partial in section and third wheel retracted onto luggage in which a release button is provided on the side portion of the bezel.
Figures 4A, 4B:
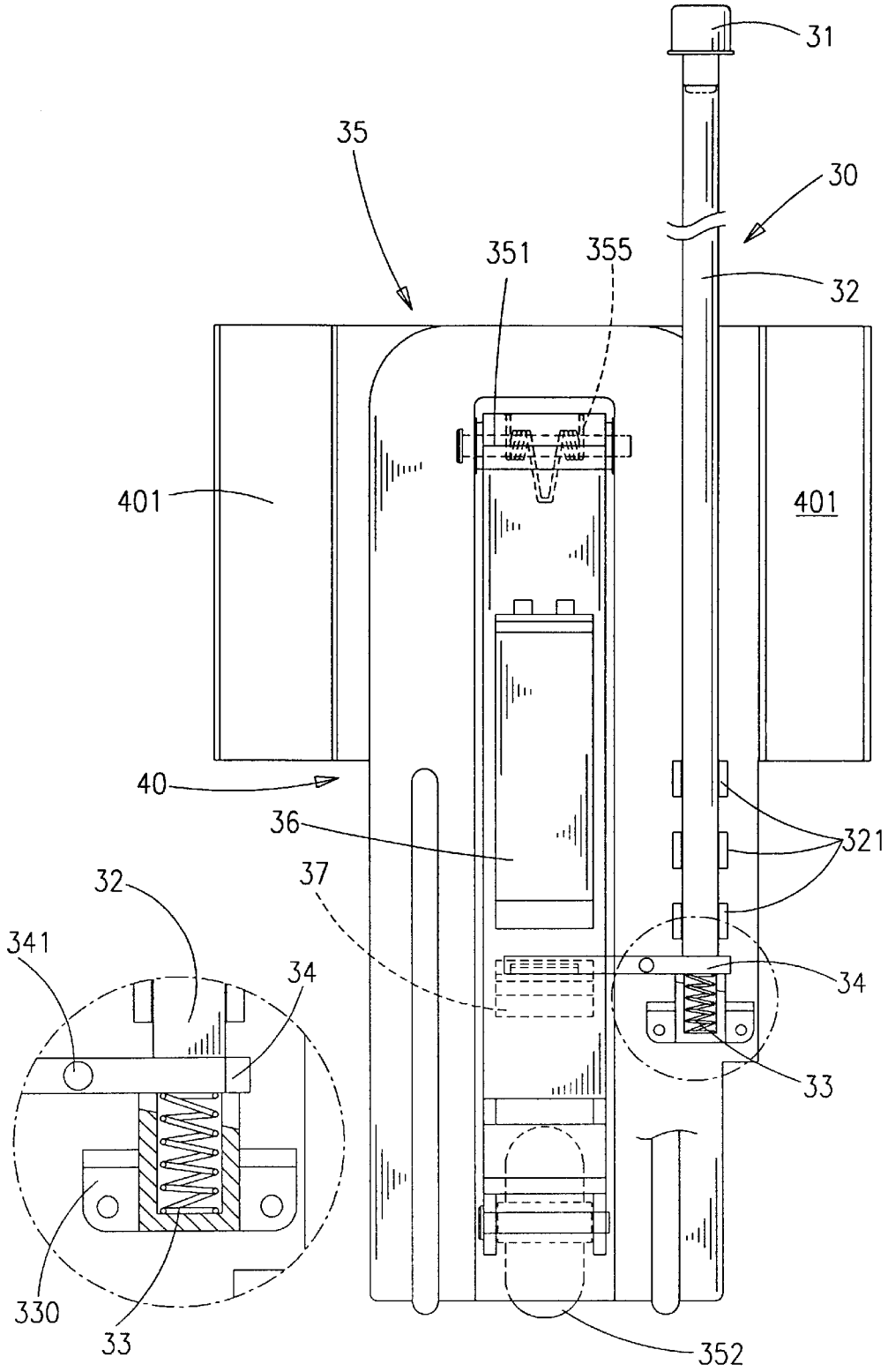
FIG. 4A is an enlarged view of third wheel control mechanism shown in FIG. 3.
FIG. 4B is a fragmentary view of FIG. 4A.
Figures 5A, 5B:
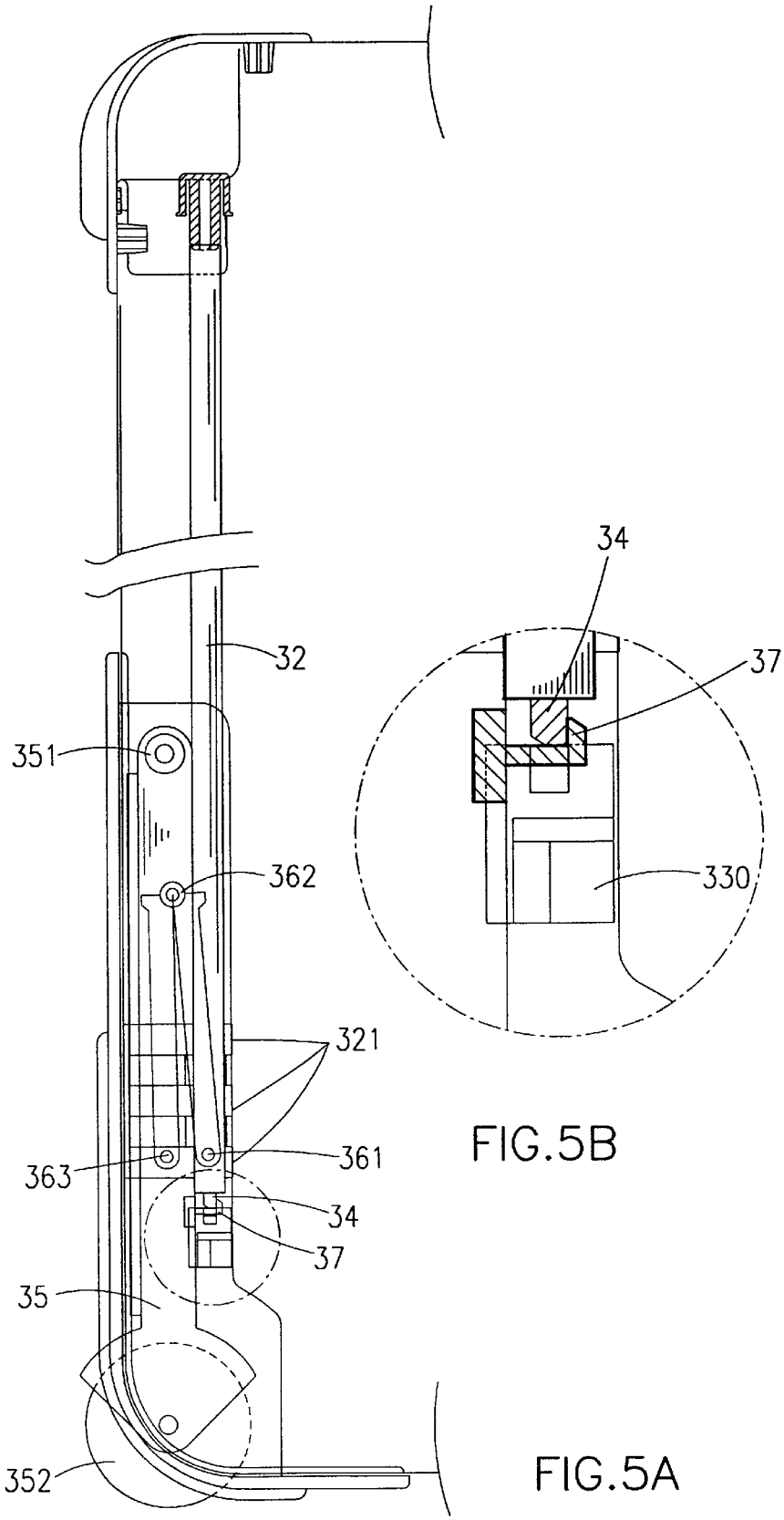
FIG. 5A is a sectional view of third wheel control mechanism with third wheel retracted onto luggage.
FIG. 5B is a fragmentary view of FIG. 5A.
Figure 6A:
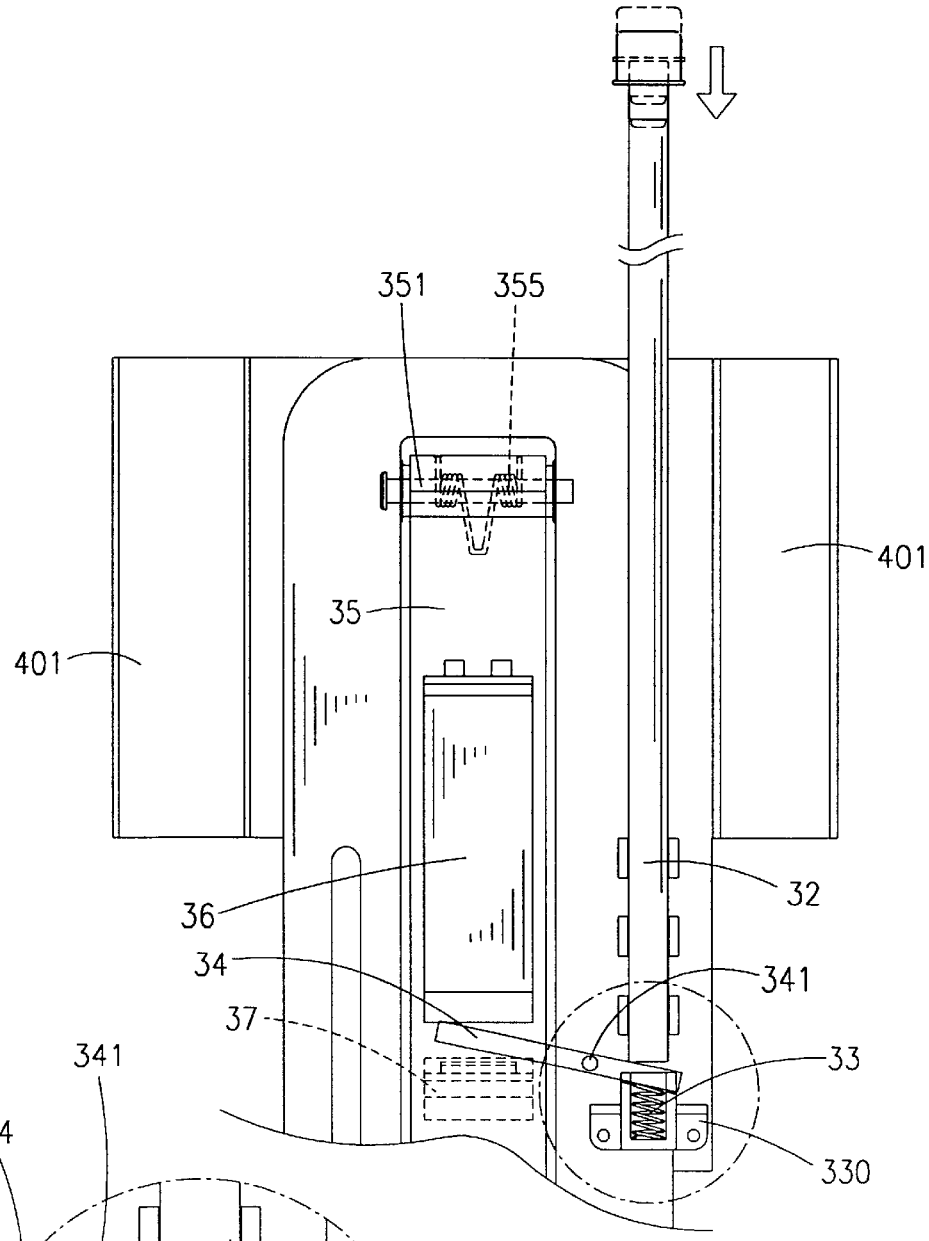
FIG. 6A is an enlarged view similar to FIG. 4A with spring compressed due to a downward movement of connecting rod when release button is pressed.

Further, it is to be noted that the third wheel bracket plate 35 is pivotally secured to the top of outer supporting plate 41 as shown in FIGS. 2, 4A, 3–6 specifically. In detail as shown in FIGS. 6–7, third wheel bracket plate 35 is pivotally secured to the outer supporting plate 41 by a resilient hinge 351. The resilient hinge 351 has a hinge pin 351A and a twin spring 355 to have the upper portion of the bracket plate 35 hinged to the upper portion of the outer supporting plate 41, as shown in FIGS. 4A, 5A and 6A. The resilient hinge 351 acts as pivotally attaching the upper portion of bracket plate 35 to the upper portion of bracket plate 35 to the upper portion of the outer supporting plate 41.

A foldable two-piece supporting member 36 has one end 363 pivotally attached to a suitable position in third wheel bracket plate 35 by a pin 363A, the other end 361 pivotally attached to lower part of outer supporting plate 41 by a pin 361A, and a resilient hinge 362 pivotally attached between a first piece (i.e., the portion between end 363 and resilient hinge 362) and a second piece (i.e., the portion between end 361 and resilient hinge 362).

As shown in FIGS. 2, 4A, 4B, the pivot lever 34 is pivotally secured to the outer and inner supporting plates 41 and 40 by a pivot pin 341, one end of pivot lever 34 is extended into the recess 411 of outer supporting plate 41, the other end thereof is supported by a spring means 33 held by a socket 330 such that the pivot lever 34 will be kept in a normal horizontal position.

Further, the top surface of the other end of said pivot lever 34 will be actuated by the bottom end of said connecting rod 32. In this manner, the pivot lever 34 functions as a latch for the hook member 37.

Figure 3A:
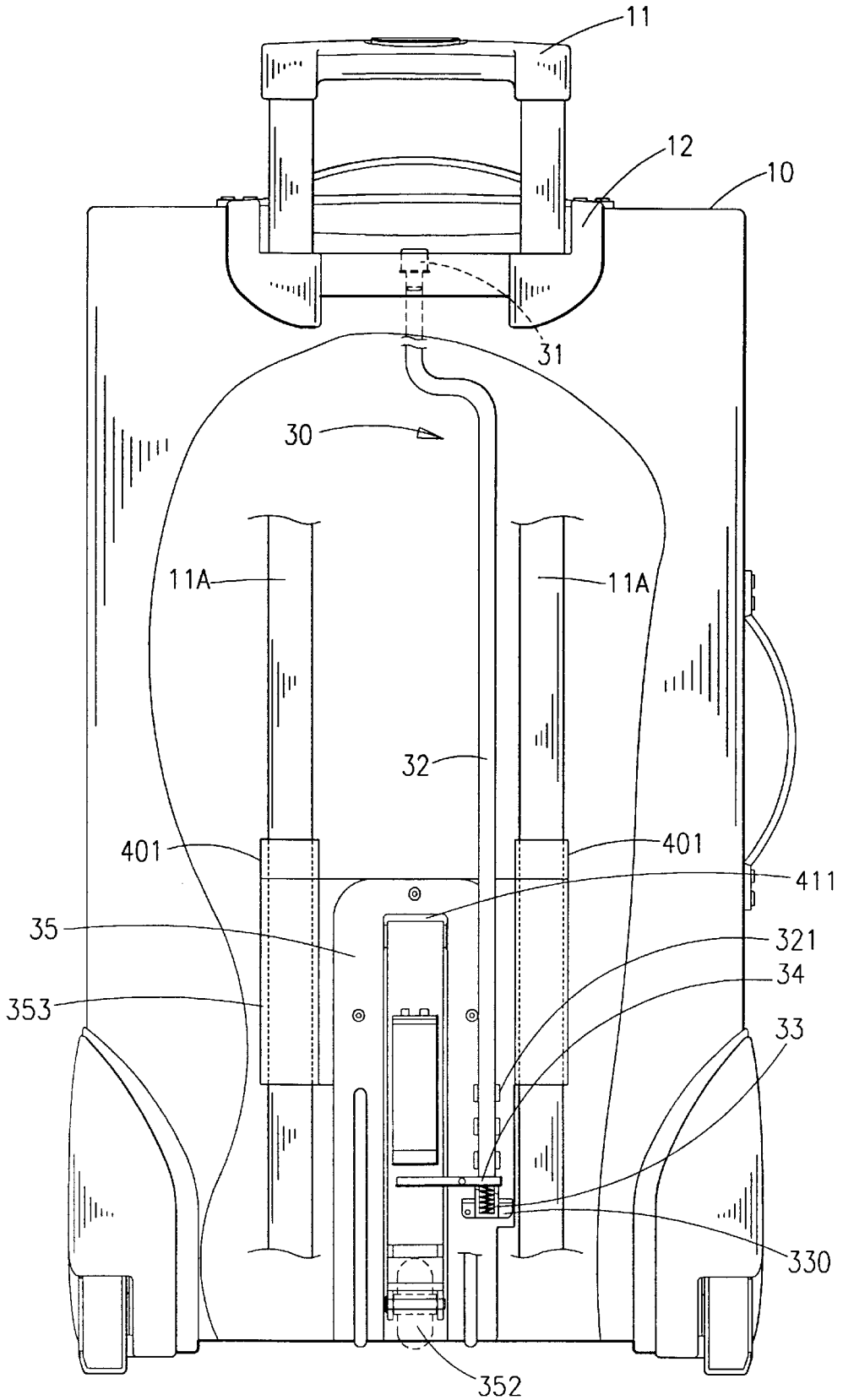
FIG. 3A is similar to FIG. 3, but the release button is provided on the center portion of the bezel.
Figure 6B:
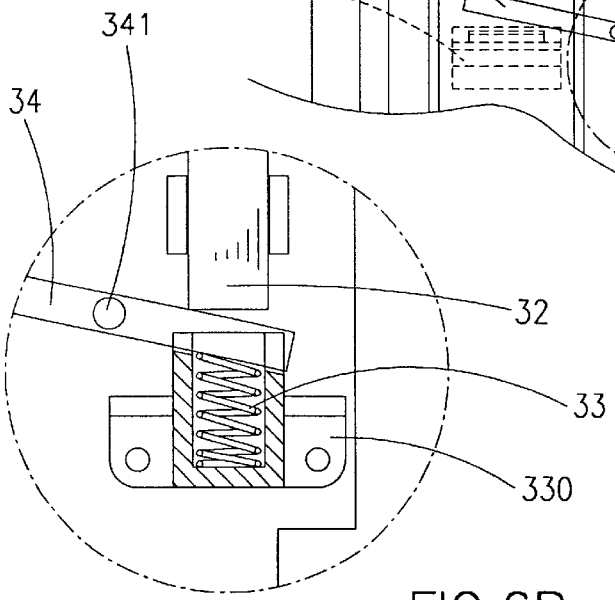
FIG. 6B is a fragmentary view of FIG. 6A.
Figure 7A:
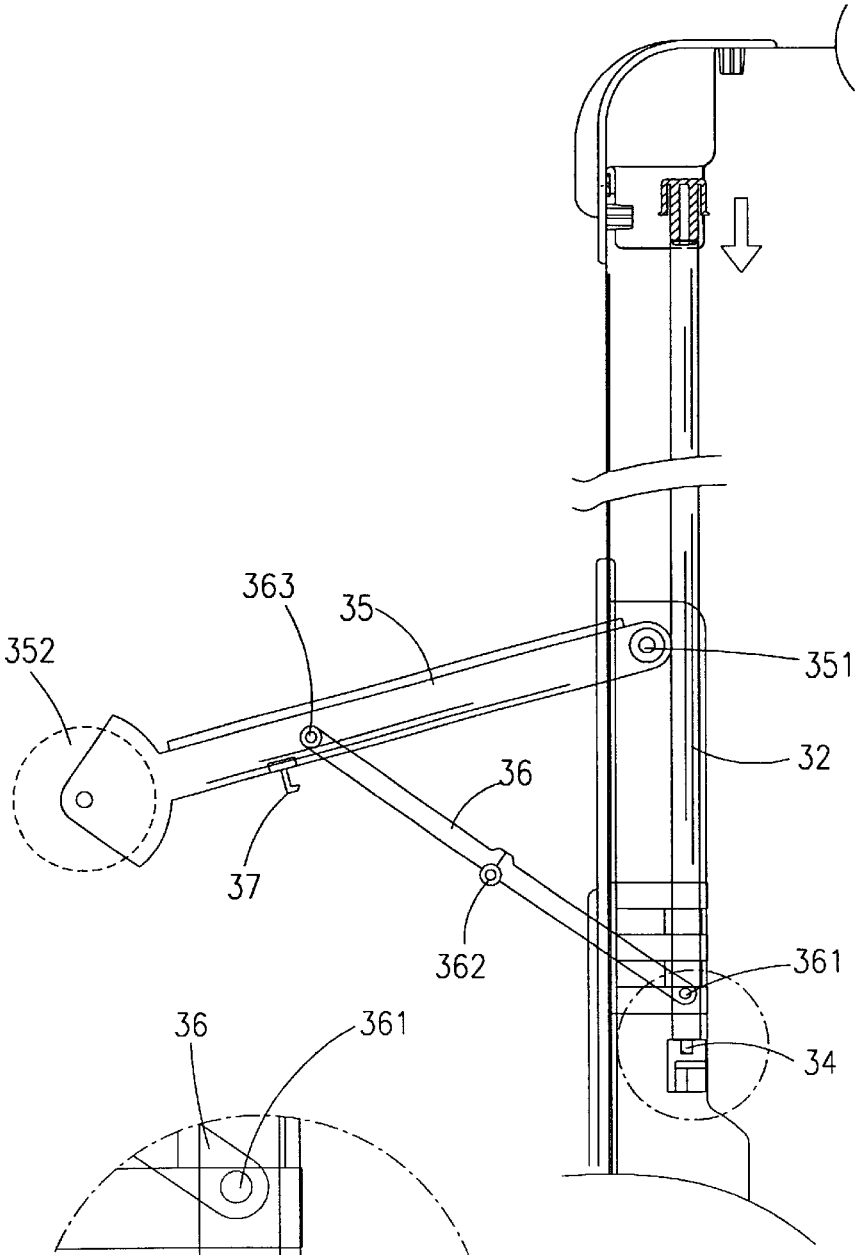
FIG. 7A is a view similar to FIG. 5A except that third wheel fully expanded.
Figure 7B:
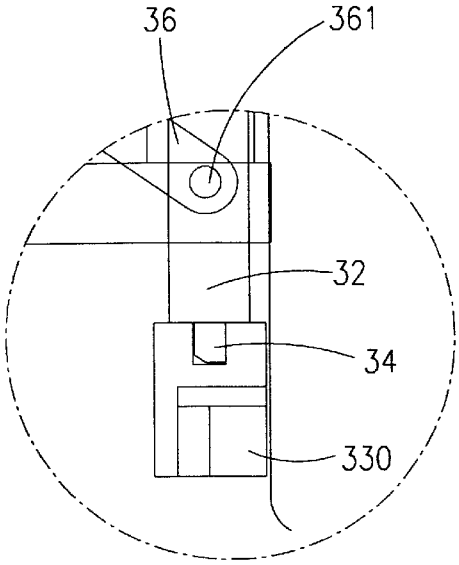
FIG. 7B is a fragmentary view of FIG. 7A.

If a user wants to use third wheel 352 he/she should press release button 31 to actuate connecting rod 32 to force pivotal lever 34 to pivot about its pivot point, i.e., left portion of pivotal lever 34 is up while right portion thereof is down, as shown in FIGS. 6A, 6B. As such, the hooking member 37 releases the pivotal lever 34. Consequently, third wheel bracket plate 35 will be expanded outwardly about resilient hinge 351 by the aid of expanding of the resilient hinge 351 and two-piece supporting member 36 (see FIG. 7). As a result, third wheel 352 is automatically extended to an operating position. On the other hand, if not used, all you have to do is only to push the third wheel bracket plate 35 together with the two-piece supporting member 36 into the outer supporting plate 41 of back plate of luggage 10 and the hooking member 37 provided at third wheel bracket plate 35 will be locked at the pivotal lever 34, as shown in FIGS. 3, 4A and 5A. As a result, the third wheel bracket plate 35 is collapsed into the luggage 10.

Figure 8:
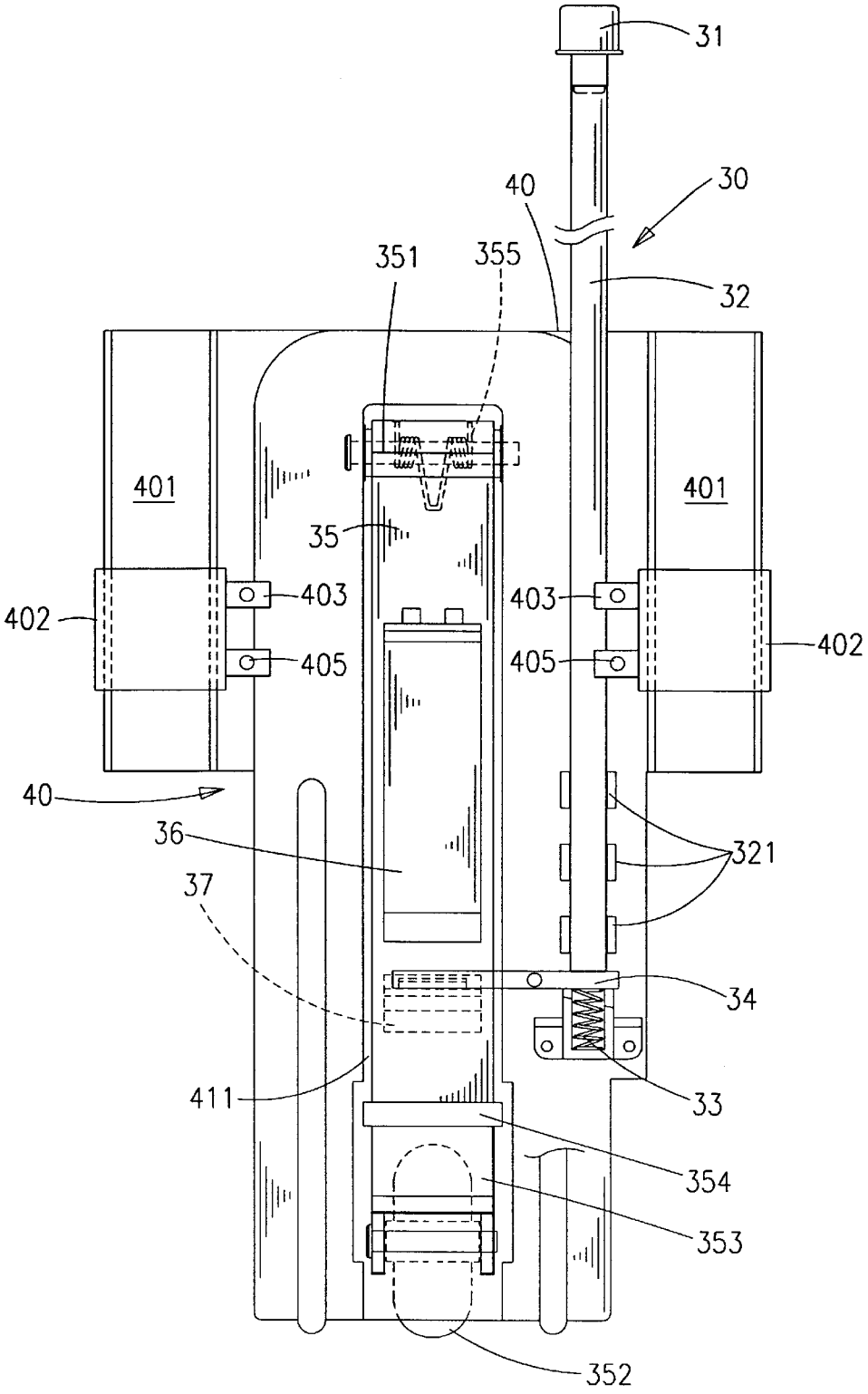
FIG. 8 is a rear view of third wheel control mechanism of a luggage according to a second preferred embodiment of the present invention.
Figure 9:
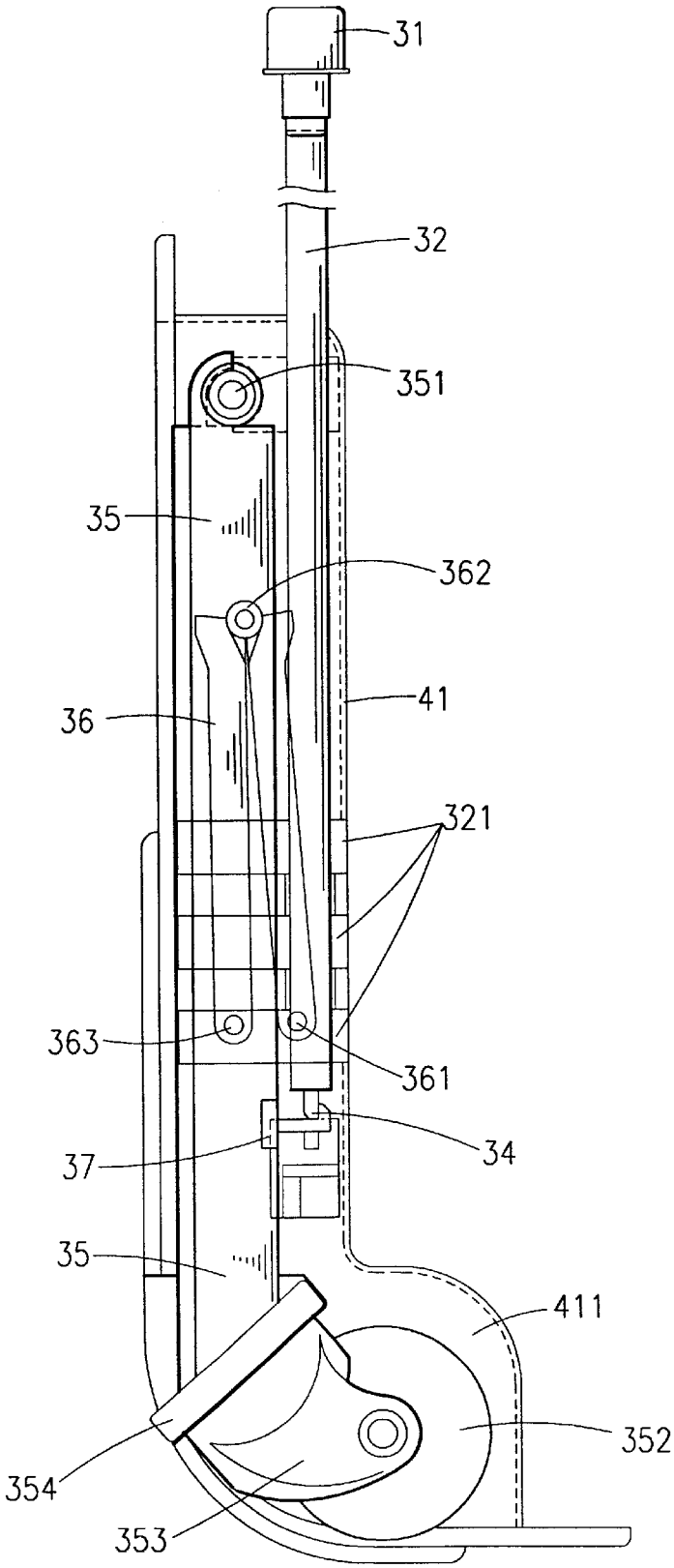
FIG. 9 is a longitudinal sectional view of third wheel control mechanism with third wheel retracted onto luggage, according to second preferred embodiment of the present invention.
Figure 10:
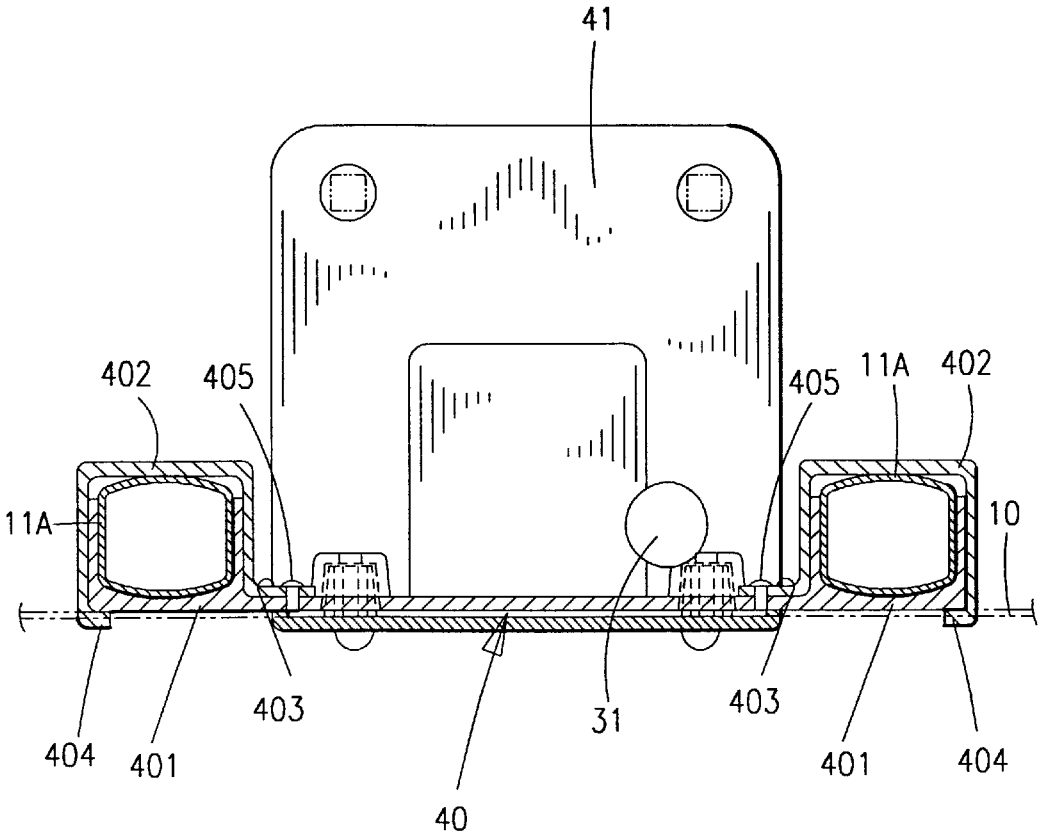
FIG. 10 is a partial top sectional view of FIG. 8.
Figure 11:
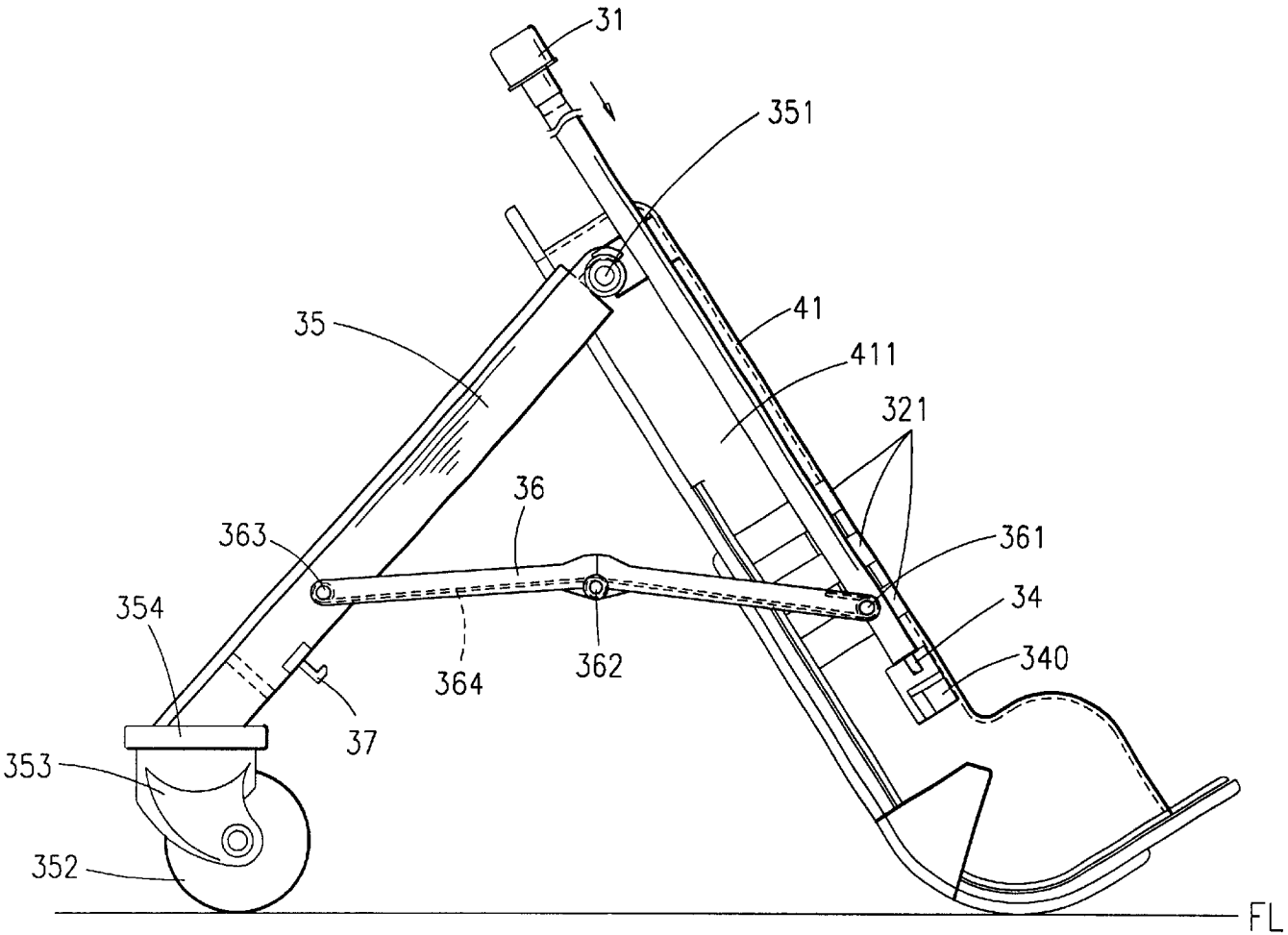
FIG. 11 is a view similar to FIG. 9 with third wheel extended outward to be in contact with the supporting surface when release button is pressed.

Referring further to FIGS. 8–13, a wheeled luggage constructed in accordance with a second preferred embodiment of the present invention will be described, in which elements corresponding to those described above with respect to the third wheel control mechanism 30 of FIGS. 2 to 7B are identified by same reference numbers, and a detailed description thereof will be omitted herein for the shake of brevity. As shown in FIGS. 8 and 10, a collar member 402 is provided to enclose a section of guiding channel 401 of inner supporting plate 40 for securing each of supporting tubes 11A to be smoothly and stably slided therethrough. The collar member 402 includes a U shape body having a latched member 404 at one opening end of said body and an extension member 403 with an opening thereon, at the other opening end of said body, that is, the latched member 404 is protruded on the one opening end of collar member 402 for further snapping on guiding channel 401. A fastener 405 such as screw or rivet is employed to secure the extension member 403 formed as a whole with collar member 402 to outer supporting plate 41. Further, a through spring means 354 (shown in phantom in FIGS. 11–12) is further provided through whole length of supporting member 36 to connect hinge pin 362 and two ends 361 and 363. As such, third wheel bracket plate 35 received in recess 411 in a retracted position is extended outwardly by the aid of extending of two-piece supporting member 36 (see FIG. 11). it is seen that in this manner, with an aid of the through spring means 364, the two-piece supporting member 36 is generally extended into a great invert V shape when third wheel 352 is in contact with supporting surface FL. As a result, third wheel 352 is automatically extended to an operating position when use, as shown in FIG. 14.

Figure 12:
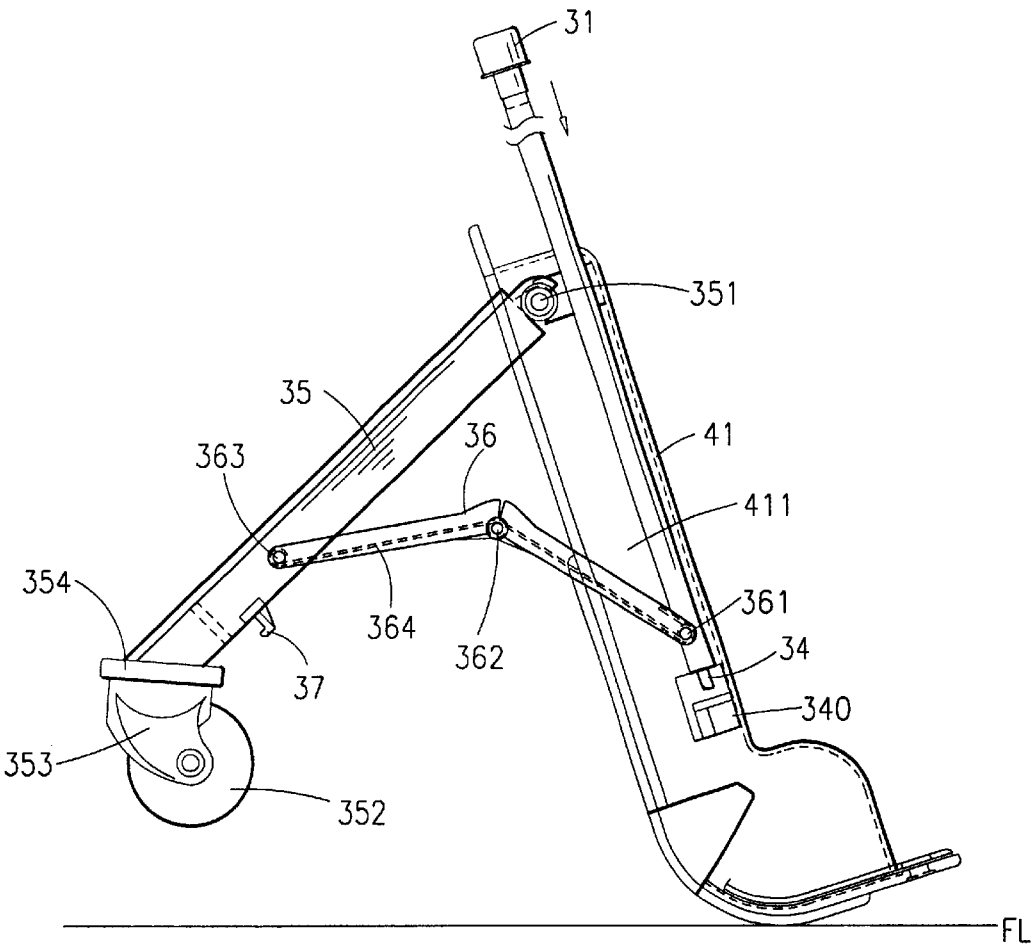
FIG. 12 is a view similar to FIG. 11, with third wheel suspended.

Referring to FIG. 12 specifically, if user wants to retract the third wheel 352 onto main body 10, user should first lift third wheel 352 to let it suspend in the air a little which in turn causes two-piece supporting member 36 to retract a little due to the compression force of spring means 364 in the supporting member 36 to form into a generally invert V shape. Then simply push the third wheel bracket plate 35 attached together with the two-piece supporting member 36 into the recess 411 of outer supporting plate 41 of back plate of main body 10 until hook member 37 provided at third wheel bracket plate 35 snaps over and catches the pivotal level 34 as shown in FIG. 9. As a result, the third wheel bracket plate 35 is collapsed into the main body 10.

Figure 13:
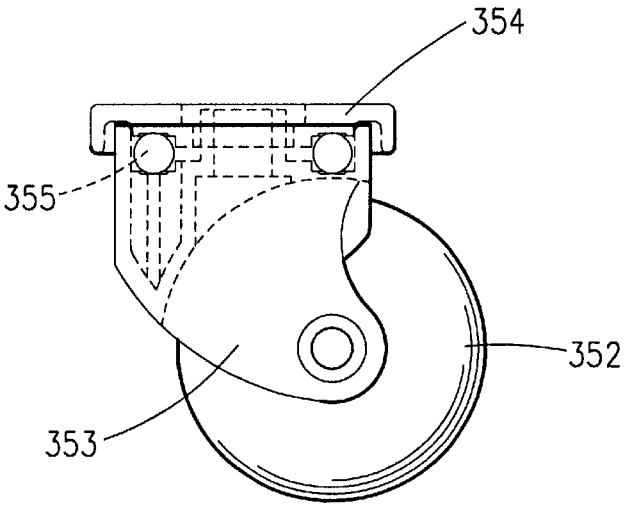
FIG. 13 is a longitudinal sectional view illustrating the swiveled frame of third wheel.
Figure 14:
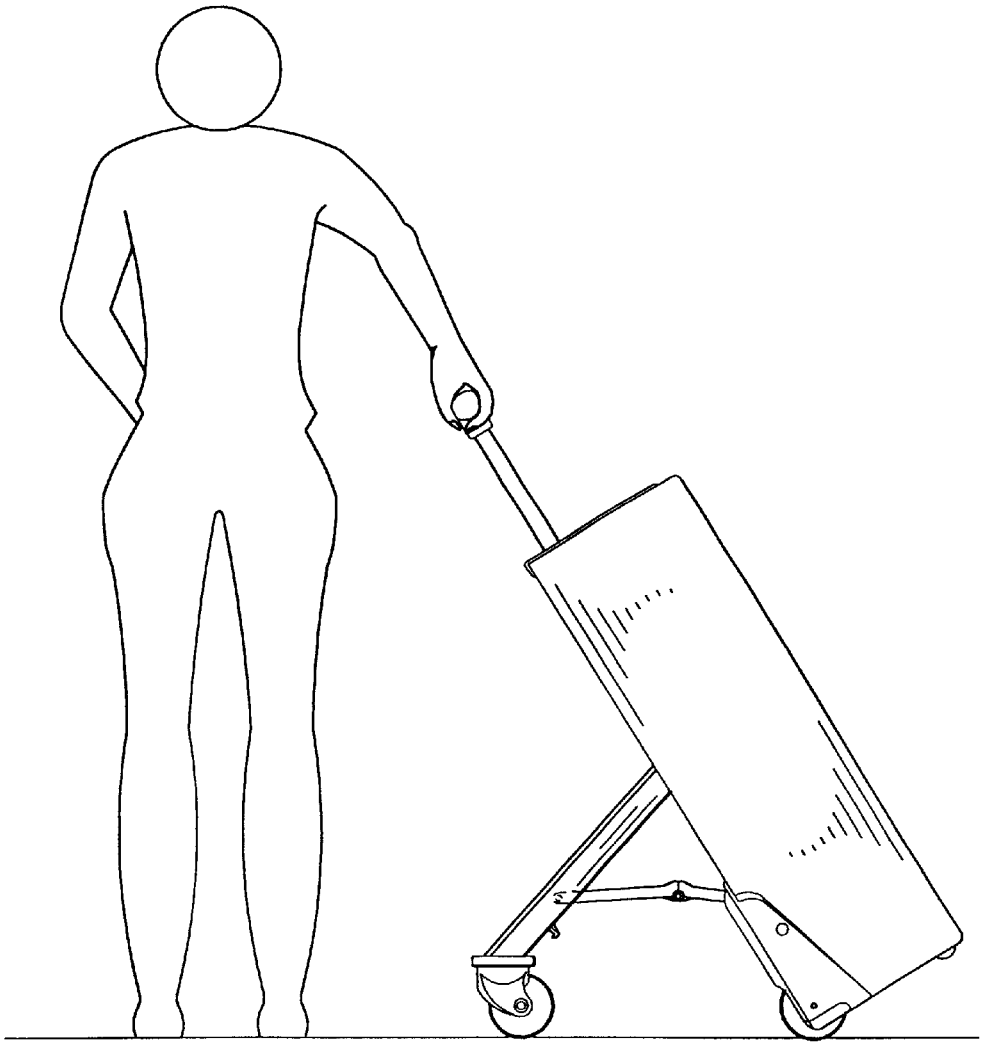
FIG. 14 is an illustrating side view of a wheeled luggage having a third wheel according to the present invention when it is used.

In FIG. 13, the swiveled frame of third wheel 352 is shown. It is designed that third wheel 352 is of caster provided on a wheel mount 353 in one end of third wheel bracket plate 35 in order to facilitate user to wheel luggage along a supporting surface. A bracket 354 is provided between one end of third wheel bracket plate 35 and wheel mount 353. Further, a number of ball bearings 355 is provided between bracket 354 and wheel mount 353, thereby enabling third wheel 352 to be vertically and axially rotated about third wheel bracket plate 35. It is understood that whenever third wheel 352 is suspended in the air it will automatically rotate and align with recess 411 so as to facilitate to retract into recess 411.

While the invention herein disclosed has been described by means of specific embodiments, numerous modifications and variations could be made thereto by those skilled in the art without departing from the scope of the invention set forth in the claims.

What is claimed is:

1. A wheeled luggage with a third wheel control mechanism comprising:

a luggage;

a bezel provided on a top of the luggage;

a retractable handle provided within a rear portion of the luggage;

a third wheel control mechanism provided below the bezel comprising:

a release button with the bezel;

a vertically disposed connecting rod actuated by said release button;

a pivotal lever actuated by said connecting rod;

a spring means for keeping said pivotal lever in a horizontal position normally;

a third wheel bracket plate having a third wheel at a lower portion and a resilient hinge means at an upper portion to have said third wheel bracket plate pivotally attached to a back plate of said luggage; and a hooking means for locking said third wheel bracket plate onto said back plate of said luggage by engaging with said pivotal lever when retracted;

whereas when said release button is pressed by user to actuate said connecting rod to force said pivotal lever means to be pivoted about its pivot point, said hooking member releases said pivotal lever means so as to enable said third wheel bracket plate to be extended outwardly by the action of said resilient hinge means thus resulting the third wheel automatically extended to an operating position ready for use.

2. The wheeled luggage with a third wheel control mechanism as claimed in claim 1, wherein said third wheel control mechanism further comprises a foldable two-piece supporting member having one end pivotal attached to said third wheel bracket plate and the other end pivotal attached to said back plate of said luggage.

3. The wheeled luggage with a third wheel control mechanism as claimed in claim 1, wherein said back plate of said luggage has an inner supporting plate and an outer supporting plate combined together with an inner portion and an outer portion of a rear portion of said luggage.

4. The wheeled luggage with a third wheel control mechanism as claimed in claim 3, wherein said third wheel bracket plate is pivotally attached to the outer supporting plate of said back plate of said luggage by means of the resilient hinge means.

5. The wheeled luggage with a third wheel control mechanism as claimed in claim 1, wherein said connecting rod is supported by a plurality of supporting collars equally spaced along the lower portion of said connecting rod.

6. The wheeled luggage with a third control mechanism as claimed in claim 1, wherein said third wheel control mechanism is mounted near said retractable handle and at the lower portion of said luggage.

7. The wheeled luggage with a third wheel control mechanism as claimed in claim 1 wherein said connecting rod is disposed near said retractable handle.

8. A wheeled luggage including a main body having a recess in one end thereof, a bezel, and a retractable handle, comprising:

a third wheel control mechanism provided below the bezel including a release button disposed within a portion of the bezel;

a vertically disposed connecting rod having a top actuated by said release button;

a pivotal lever actuated by said connecting rod;

an anchored spring means provided below and urged against the bottom of said pivotal lever in a horizontal position normally; and a third wheel bracket plate received in the recess of said main body in a first position having a third wheel in a lower end, a first hinge means at an upper end to have the third wheel bracket plate pivotally attached to a back plate of the main body, and a hook means provided at an inner surface of the third wheel bracket plate being locked in the mating pivotal lever;

wherein the connecting rod is actuated by pressing the release button which in turn compresses the anchored spring means downward to force said pivotal lever to be pivoted about its pivot point, and then in turn makes said hook means disengaging from the mating pivotal lever so as to enable the third wheel bracket plate to be extended outwardly to a second position by the action of said first hinge means, and the third wheel bracket plate is collapsed into the main body by pushing the third wheel bracket plate toward the main body unit said hook means snaps over and catches the mating pivotal lever.

9. The wheeled luggage as claimed in claim 8, wherein the third wheel control mechanism comprises a two-piece supporting member having a first piece, a second piece a second hinge means pivotally attaching the first piece to the second piece, a first end pivotally attached to the third wheel bracket plate, and a second end pivotally attached to the back plate of the main body.

10. The wheeled luggage as claimed in claim 9 wherein said second hinge means comprises a through resilient means for connecting the first and the second ends whole length of the two-piece supporting member as one unit.

11. The wheeled luggage as claimed in claim 9, wherein the two-piece supporting member is of a general invert V-shape when the third wheel is suspended in the second position.

12. The wheeled luggage as claimed in claim 9, wherein the two-piece supporting member is of a greater invert V-shape when the third wheel is in contact with the supporting surface or ground.

13. The wheeled luggage as claimed in claim 8, wherein the third wheel is of caster so as to vertically and axially rotate about the third wheel bracket plate and align with the recess when suspended.

14. The wheeled luggage as claimed in claim 8, wherein the release button is provided in the center portion of the bezel and the connecting rod is disposed between two supporting tubes.

15. The wheeled luggage as claimed in claim 8, wherein the release button is provided in the side portion of the bezel and the connecting rod is disposed near one of two supporting tubes.

16. The wheeled luggage as claimed in claim 8, wherein a collar member is further provided to enclose a section of a guiding channel of an inner supporting plate on the back plate of main body.

17. The wheeled luggage as claimed in claim 16, wherein said collar member comprises a U shape body having a latched member protruded at one opening end of said body for further snapping on the guiding channel and an extension member provided at the other opening end of said body having a hole thereon for using a fastener securing to the outer supporting plate.

* * * * *